US011401795B2

(12) United States Patent
Gunda et al.

(10) Patent No.: US 11,401,795 B2
(45) Date of Patent: Aug. 2, 2022

(54) COLLAR CONTROL SYSTEM FOR MOBILE DRILLING MACHINES

(71) Applicants: Caterpillar Global Mining Equipment LLC, Denison, TX (US); Caterpillar Global Mining HMS GmbH, Dortmund (DE)

(72) Inventors: Rajesh R. Gunda, Dunlap, IL (US); Carl J. Moberg, Dunlap, IL (US); Timo Diekmann, Castrop-Rauxel (DE); Ross L. Hoult, Queensland (AU)

(73) Assignee: Caterpillar Global Mining Equipment LLC, Denison, TX (US)

( * ) Notice: Subject to any disclaimer, the term of this patent is extended or adjusted under 35 U.S.C. 154(b) by 11 days.

(21) Appl. No.: 16/921,108

(22) Filed: Jul. 6, 2020

(65) Prior Publication Data

US 2021/0017848 A1 Jan. 21, 2021

Related U.S. Application Data

(60) Provisional application No. 62/876,481, filed on Jul. 19, 2019.

(51) Int. Cl.

| | |
|---|---|
| ***E21B 44/02*** | (2006.01) |
| ***E21B 7/28*** | (2006.01) |
| ***E21B 7/02*** | (2006.01) |

(52) U.S. Cl.

CPC ..... *E21B 44/02* (2013.01); *E21B 7/022* (2013.01); *E21B 7/025* (2013.01); *E21B 7/28* (2013.01)

(58) Field of Classification Search

CPC . E21B 7/022; E21B 7/025; E21B 7/28; E21B 44/02

See application file for complete search history.

(56) References Cited

U.S. PATENT DOCUMENTS

| | | | |
|---|---|---|---|
| 2,847,189 | A | 8/1958 | Shook |
| 3,085,639 | A | 1/1961 | Fitch |
| 3,613,805 | A | 10/1971 | Lindstad et al. |
| 5,358,058 | A | 10/1994 | Edlund et al. |

(Continued)

FOREIGN PATENT DOCUMENTS

| | | |
|---|---|---|
| GB | 774077 | 5/1957 |
| GB | 2 330 609 A | 4/1999 |

*Primary Examiner* — Taras P Bemko

(74) *Attorney, Agent, or Firm* — Bookoff McAndrews PLLC

(57) ABSTRACT

A collar control system and methods for mobile drilling machines are disclosed. One method may include: automatically initiating rotation of a drill bit based on collar settings; automatically feeding the drill bit at a feed rate to form an initial hole at a predetermined reaming increment; and automatically retracting the drill bit from the initial hole when the predetermined reaming increment is achieved, but prior to reaching a collar depth. Another method may include: measuring values of multiple drill bit inputs at a predetermined sample depth region during the collar operation; storing average values for each of the drill bit inputs over the predetermined sample depth region; monitoring values of the drill bit inputs when the drill bit moves beyond the predetermined sample depth region; and ending the collar operation prior to a desired collar depth when any of the monitored values change by a predetermined threshold.

20 Claims, 4 Drawing Sheets

(56) References Cited

U.S. PATENT DOCUMENTS

| | | | | |
|---|---|---|---|---|
| 5,495,899 | A | 3/1996 | Pastusek et al. | |
| 6,116,356 | A | 9/2000 | Doster et al. | |
| 7,762,346 | B2 | 7/2010 | Jonsson | |
| 2011/0108323 | A1 | 5/2011 | Stacy, II | |
| 2012/0255775 | A1* | 10/2012 | Stacy, II | E21B 7/00 175/24 |
| 2018/0187540 | A1 | 7/2018 | Hanski | |

* cited by examiner

COLLAR CONTROL SYSTEM FOR MOBILE DRILLING MACHINES

CROSS-REFERENCE TO RELATED APPLICATIONS

This application claims the benefit of priority under 35 U.S.C. § 119 to U.S. Provisional Patent Application No. 62/876,481, filed on Jul. 19, 2019, the entirety of which is incorporated herein by reference.

TECHNICAL FIELD

The present disclosure relates generally to mobile drilling machines, and more particularly, to a collar control system for such machines.

BACKGROUND

Mobile drilling machines, such as blasthole drilling machines, are typically used for drilling blastholes for mining, quarrying, dam construction, and road construction, among other uses. The process of excavating rock, or other material, by blasthole drilling comprises using the blasthole drill machine to drill a plurality of holes into the rock and filling the holes with explosives. The explosives are detonated causing the rock to collapse and rubble of the collapse is then removed and the new surface that is formed is reinforced. Many current blasthole drilling machines utilize rotary drill rigs, mounted on a mast that can drill blastholes anywhere from 6 inches to 22 inches in diameter and depths up to 180 feet or more.

Blasthole drilling machines may also include an automatic drilling mode. The automatic drilling mode may include an automatic collar operation. For example, the ground surface may be fractured and/or may include loose material (e.g., material left from a previous blast) such that it is difficult to form an initial hole for drilling. The collar operation, or collaring, may include forming an initial hole at reduced drill settings (e.g., reduced drill rotation speed and feed rate) before initiating the drilling operation to drill a hole. Therefore, collaring may be used to set a base for the hole. During collaring, loose material may accumulate on top of the drill bit causing the drill bit to clog and/or air pressure to increase as the hole depth increases and may result in a jam. Further, in some instances, the collar depth may be set by the operator or predetermined, in which case the depth may not correspond to the actual required collar depth.

U. S. Patent Application Publication No. 2011/0108323, published on May 12, 2011 ("the '323 publication"), describes a system for drilling a borehole that receives information from the drill rig that relates to at least one drill parameter. The system of the '323 publication monitors a penetration rate during a first phase of collaring and then initiates a second phase of collaring when the penetration rate falls below a predetermined level for a predetermined period of time. The first phase of collaring advances the drill bit to a predetermined depth and the second phase of collaring retracts the drill bit above the surface. However, the '323 publication does not disclose mitigating or preventing jams and clogs prior to collaring to the predetermined depth. Further, the system of the '323 publication may include an overall longer drilling operation due to the second phase of collaring of retracting the drill bit above the surface prior to beginning the drilling operation.

The systems and methods of the present disclosure may address or solve one or more of the problems set forth above and/or other problems in the art. The scope of the current disclosure, however, is defined by the attached claims, and not by the ability to solve any specific problem.

SUMMARY

In one aspect, a method for automated control of a collar operation of a mobile drilling machine using a drill bit mounted on a drill string is disclosed. The method may include: automatically initiating rotation of the drill bit at a rotation speed based on collar settings; automatically feeding the drill bit at a feed rate to form an initial hole at a predetermined reaming increment; and automatically retracting the drill bit from the initial hole when the predetermined reaming increment is achieved, but prior to reaching a collar depth.

In another aspect, a mobile drilling machine is disclosed. The mobile drilling machine may include: a mast including a mast frame; a rotary head movably mounted on the mast frame, the rotary head controllable to rotate a drill bit mounted on a drill string at a rotation speed, wherein the rotary head is further controllable to move up and down the mast frame to feed the drill bit at a feed speed; and a controller configured to: automatically initiate rotation of the drill bit at a rotation speed based on collar settings; automatically feed the drill bit at a feed rate to form an initial hole at a predetermined reaming increment; and automatically retract the drill bit from the initial hole when the predetermined reaming increment is achieved, but prior to reaching a collar depth.

In yet another aspect, a method for automatically adjusting a collar depth during a collar operation of a mobile drilling machine including a drill bit mounted on a drill string is disclosed. The method may include: measuring values of multiple drill bit inputs at a predetermined sample depth region during the collar operation; storing average values for each of the drill bit inputs over the predetermined sample depth region; monitoring values of the drill bit inputs when the drill bit moves beyond the predetermined sample depth region; and ending the collar operation prior to a desired collar depth when any of the monitored values change by a predetermined threshold.

In yet another aspect, a mobile drilling machine is disclosed. The mobile drilling machine may include: a mast including a mast frame; a rotary head movably mounted on the mast frame, the rotary head controllable to rotate a drill bit mounted on a drill string at a rotation speed, wherein the rotary head is further controllable to move up and down the mast frame to feed the drill bit at a feed speed; and a controller configured to: measure values of multiple drill bit inputs at a predetermined sample depth region during a collar operation; store average values for each of the drill bit inputs over the predetermined sample depth region; monitor values of the drill bit inputs when the drill bit moves beyond the predetermined sample depth region; and end the collar operation prior to a desired collar depth when any of the monitored values change by a predetermined threshold.

BRIEF DESCRIPTION OF THE DRAWINGS

The accompanying drawings, which are incorporated in and constitute a part of this specification, illustrate various exemplary embodiments and together with the description, serve to explain the principles of the disclosure.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Further, relative terms, such as, for example, "about," "substantially," "generally," and "approximately" are used to indicate a possible variation of ±10% in a stated value.

Figure 1:
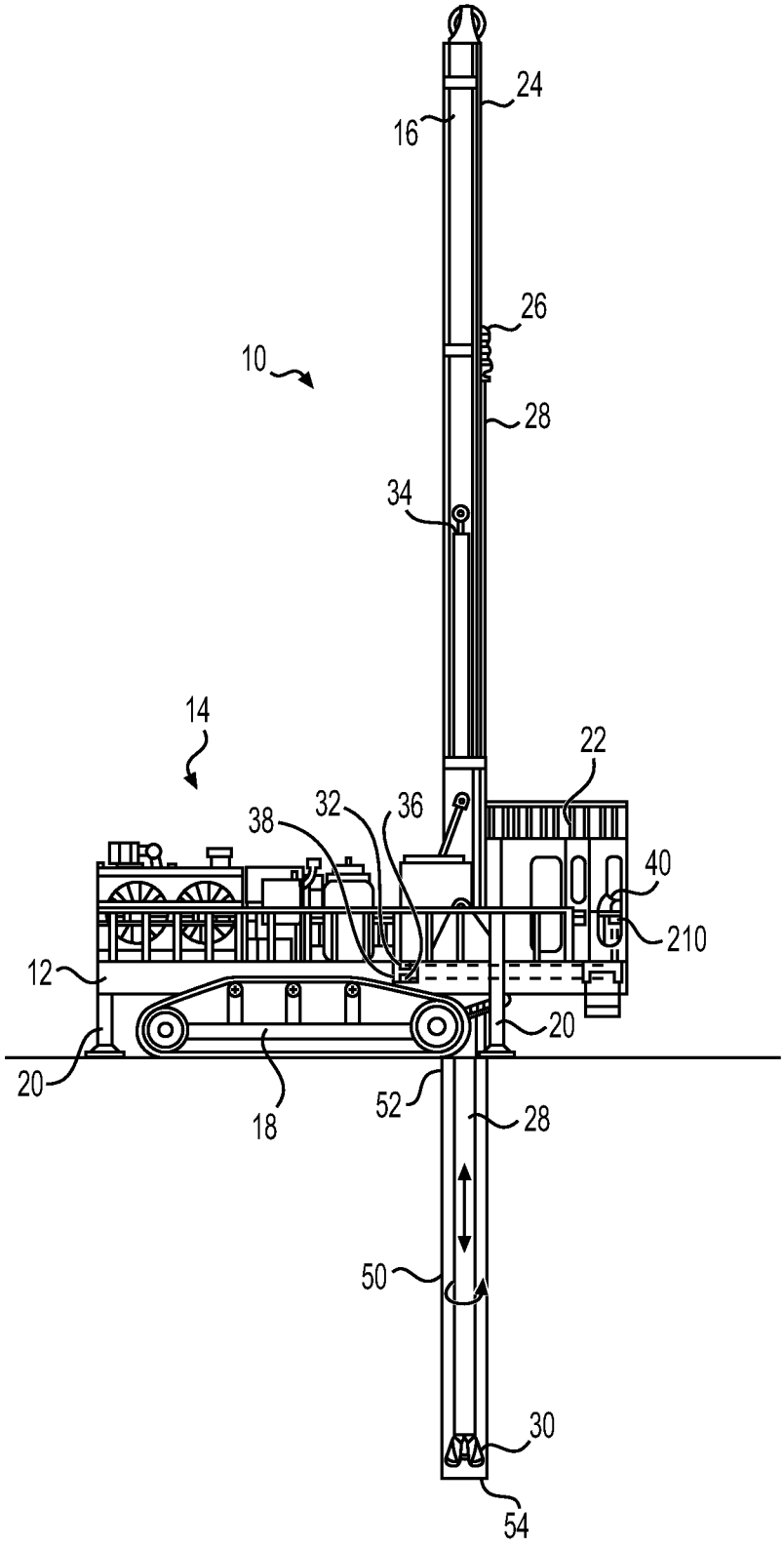
FIG. 1 illustrates a schematic side view of a drilling machine with an exemplary collar control system, according to aspects of the disclosure.

FIG. 1 illustrates a schematic side view of an exemplary drilling machine 10. The disclosure herein may be applicable to any type of drilling machine, however, reference will be made below particularly to a mobile blasthole drilling machine. As shown in FIG. 1, mobile drilling machine 10 may include a frame 12, machinery 14, and a drilling mast 16. Frame 12 may be supported on a ground surface by a transport mechanism, such as crawler tracks 18. Crawler tracks 18 may allow mobile drilling machine 10 to maneuver about the ground surface to a desired location for a drilling operation. Frame 12 may further include one or more jacks 20 for supporting and leveling mobile drilling machine 10 on the ground surface during the drilling operation. Frame 12 may support the machinery 14, which may include engines, motors, batteries, pumps, air compressors, a hydraulic fluid storage tank 38 (shown schematically in FIG. 1) and/or any other equipment necessary to power and operate mobile drilling machine 10. Frame 12 may further support an operator cab 22, from which a user, or operator, may maneuver and control mobile drilling machine 10 via an input device 40, such as user interfaces and displays. It is understood that input device 40 may be located remote from mobile drilling machine 10 such that mobile drilling machine 10 may be controlled remotely.

As further shown in FIG. 1, drilling mast 16 may include a mast frame 24 which may support a drill motor assembly, or rotary head 26, movably mounted on the mast frame 24. Rotary head 26 may couple to, and may be controllable to rotate, a drill string 28 of drilling pipe segments on which a drill bit 30 may be mounted for drilling into the ground surface for collar, as further described below. Mobile drilling machine 10 may include any type of drill bit 30, such as a rotary drill bit, a claw drill bit, a down-the-hole bit, etc. Rotary head 26 may be any type of rotary head, such as a hydraulic rotary head or the like. Rotary head 26 may further include a hydraulic fluid line (not shown) for receiving hydraulic fluid. The hydraulic fluid may be used to rotate a shaft of rotary head 26 on which the drill string 28 is connected for rotating the drill string 28 (and thus rotating drill bit 30). The hydraulic fluid line of rotary head 26 may be coupled to a hydraulic valve 32 (shown schematically in FIG. 1) for controlling the amount, and flow rate, of the hydraulic fluid into rotary head 26. In the exemplary embodiment, hydraulic valve 32 may be located on the hydraulic fluid storage tank 38. However, hydraulic valve 32 may be located anywhere along the hydraulic fluid line of the rotary head 26, as necessary.

Drilling mast 16 may further include a hydraulic feed cylinder 34 (located within mast frame 24) connected to rotary head 26 via a cable and pulley system (not shown) for moving rotary head 26 up and down along the mast frame 24. As such, when hydraulic feed cylinder 34 is extended, hydraulic feed cylinder 34 may exert a force on rotary head 26 for pulling-down rotary head 26 along mast frame 24. Likewise, when hydraulic feed cylinder 34 is retracted, hydraulic feed cylinder 34 may exert a force on rotary head 26 for hoisting up rotary head 26 along mast frame 24. Thus, hydraulic feed cylinder 34 may be controllable to move rotary head 26 up and down the mast frame 24 such that drill bit 30 on drill string 28 may be pulled-down towards, and into, the ground surface or hoisted up from the ground surface. As used herein, the term "feed" in the context of the feed cylinder 34 includes movement of the drill string 28 in either direction (up or down). Hydraulic feed cylinder 34 may include hydraulic fluid lines (not shown) for receiving and conveying hydraulic fluid to and from the feed cylinder 34. The hydraulic fluid may be used to actuate hydraulic cylinder 34 such that a rod of hydraulic cylinder 34 may be extended or retracted. The hydraulic fluid line of hydraulic cylinder 34 may be coupled to hydraulic valves 36 (shown schematically in FIG. 1) for controlling the amount, and flow rate and pressure, of the hydraulic fluid into hydraulic cylinder 34. In the exemplary embodiment, hydraulic valve 36 may be located on the hydraulic fluid storage tank 38. However, hydraulic valve 36 may be located anywhere along the hydraulic fluid line of the hydraulic cylinder 34, as necessary. It is understood that hydraulic fluid may be any type of hydraulic fluid, such as hydraulic oil or the like.

FIG. 1 shows the drill string 28 located in hole 50. The hole 50 includes a collar portion 52 at a top portion of the hole, and a bottom of the hole 54 (e.g., desired depth of hole). As shown by the arrows in FIG. 1, drill string 28 can rotate, and move up and down (e.g. feed and retract/hoist) such that drill bit 30 rotates and moves up and down, respectively. Drill bit 30 can also reciprocate (e.g. when a down-the-hole drill bit is used). Further drill string 28 may include water and air lines (not shown) for supplying water and/or compressed air through the drill bit 30 to the hole 50.

Figure 2:
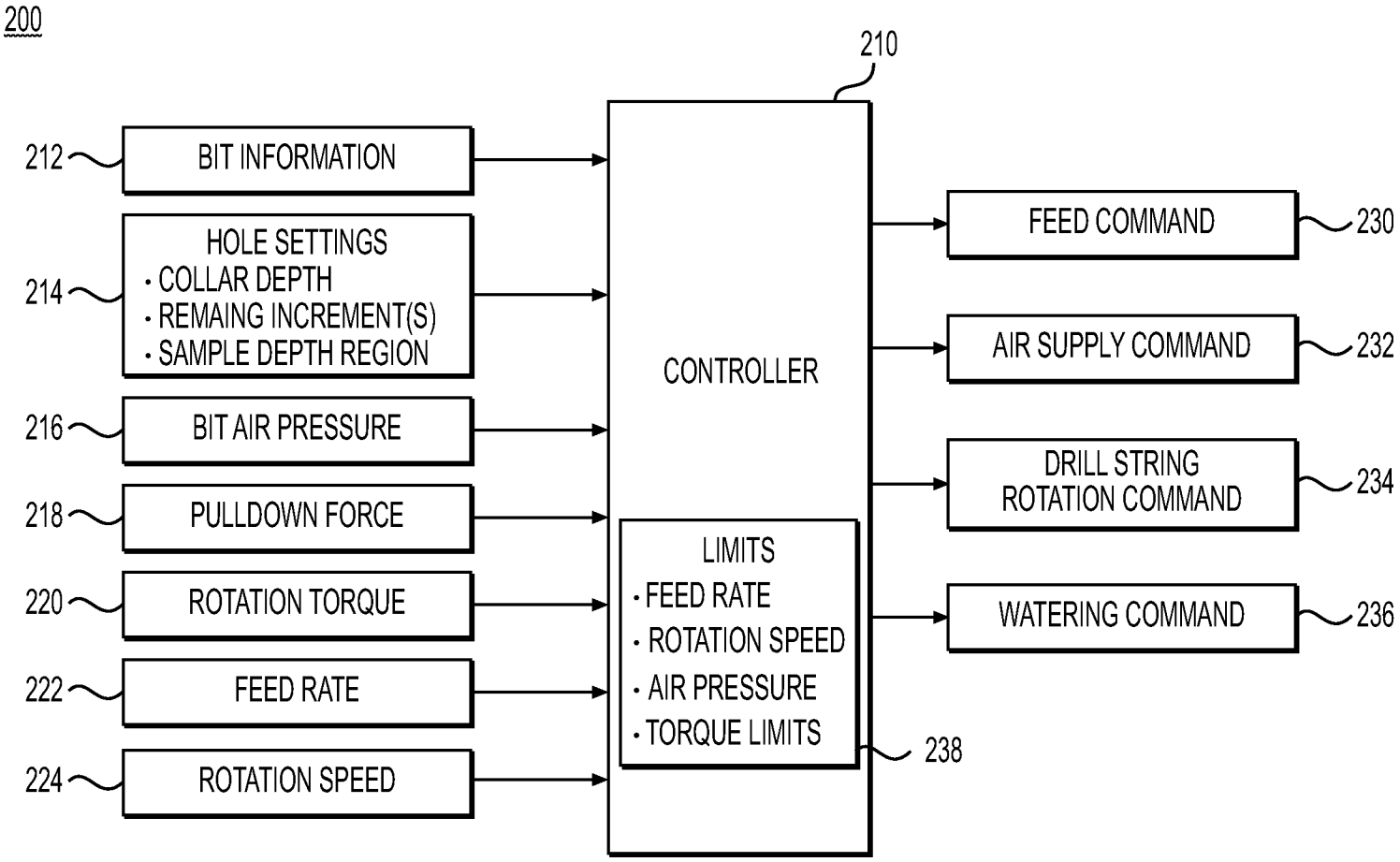
FIG. 2 illustrates a schematic view of the exemplary collar control system of the drilling machine of FIG. 1.

FIG. 2 illustrates a schematic view of the exemplary collar control system 200 of the drilling machine of FIG. 1. Control system 200 may include inputs 212-224, controller 210, and outputs 230-236. The inputs may include sensor input, operator inputs, or stored inputs, for example, bit information 212, desired hole settings 214, feed rate limits, rotation speed limits, air pressure limits and torque limits, bit air pressure 216, pulldown force 218, rotation torque 220, feed rate 222, and rotation speed 224. Such sensors, operation input, or stored inputs may be obtained using any conventional system (sensors, user inputs, etc.) The outputs may include, for example, a feed command 230, air supply command 232, drill string rotation command 234, and watering command 236.

Controller 210 may embody a single microprocessor or multiple microprocessors that may include means for monitoring operation of the drilling machine 10 and issuing instructions to components of machine 10. For example, controller 210 may include a memory, a secondary storage device, a processor, such as a central processing unit or any other means for accomplishing a task consistent with the present disclosure. The memory or secondary storage device associated with controller 210 may store data and/or software routines that may assist controller 210 in performing its functions. Further, the memory or secondary storage device associated with controller 210 may also store data received from the various inputs 102 associated with mobile drilling machine 10. Numerous commercially available microprocessors can be configured to perform the functions of controller 210. It should be appreciated that controller 210 could readily embody a general machine controller capable of controlling numerous other machine functions. Various other known circuits may be associated with controller 210, including signal-conditioning circuitry, communication circuitry, hydraulic or other actuation circuitry, and other appropriate circuitry.

As shown in FIG. 2, controller 210 may also store certain limits 238 associated with drilling machine 10. These limits may include one or more of rotation speed limits, air pressure limits, and torque limits. Feed rate limits may include maximum limits for the feed rate of the drill bit 30. Rotation speed limits may include maximum limits for the rotation speed of the drill bit 30. Air pressure limits may include maximum limits for an amount of air pressure provided for the drill bit 30. Torque limits may include maximum limits for rotational torque on the drill bit 30. These limits 238 may be provided to controller 210 in any conventional manner and may be configurable.

Bit information input 212 may include a user input of bit type and a weight on the bit per diameter. Bit type may include, for example, a rotary drill bit, a claw drill bit, a down-the-hole bit, or any other type of drill bit. The weight on the bit per diameter may be determined by a user input of the diameter of the bit. The user input may be received from an input device 40, such as a computing device, number pad, or the like.

Hole settings input 214 may include, for example, a desired collar depth, reaming increments, sample depth, and desired hole depth. Desired collar depth may be the desired depth in which the front end, or collar, of the hole 50 is drilled. Reaming increments may be depth increments by which the hole may collared. Sample depth region may be a small region (e.g., between two predetermined depths) of the collar portion 52 of hole 50. Desired hole depth may be the desired depth in which the hole 50 is drilled during the automatic drilling operation. These inputs 214 may be provided by the operator of the mobile drilling machine 10, and/or be preset by the manufacturer of the machine, service personnel, or engineers associated with the machine 10. Further, such values may be preset and non-configurable, or configurable.

Bit air pressure input 216 may be a sensor for detecting and/or communicating a net force acting on an air supply line. Forces acting on the air supply line may include air pressure. Bit air pressure input 216 may be an air pressure sensor configured to communicate an air pressure signal indicative of air pressure of the air supply line on the drill bit 30 to controller 210. For example, an air pressure sensor may be located in the air supply line adjacent the drill bit 30 so as to detect pressure of fluid (e.g., air) within the air supply line. Bit air pressure input 216 may also derive air pressure information from other sources, including other sensors.

Pulldown force input 218 may be a sensor or other mechanism configured to detect and/or communicate a pulldown force acting on the drill bit 30. The pulldown force acting on the drill bit 30 may be the force exerted by the hydraulic feed cylinder 34 through the rotary head 26 to the drill bit 30. As such, the pulldown force may be derived from a pressure of the hydraulic feed cylinder. Pulldown force input 218 may be a sensor for detecting a net force acting on the hydraulic feed cylinder 34, which may be controlled by controller 210. Forces acting on the hydraulic feed cylinder 34 may include a head end pressure and a rod end pressure. For example, pulldown force input 218 may be one or more pressure sensors configured to communicate a pressure signal to controller 210. The pressure sensors may be disposed within a hydraulic fluid line, at a pump of the hydraulic fluid tank 36, or in a head of the hydraulic feed cylinder 34. Further, pulldown force input 218 may include a weight of the drill string 28 on the drill bit 30. As such, the pressure signals may be added to the weight of the drill string 28 acting on the drill bit 30. Alternatively, any sensor associated with pulldown force input 218 may be disposed in other locations relative to the hydraulic feed cylinder 34. Pulldown force input 218 may also derive pulldown force information from other sources, including other sensors.

Rotation torque input 220 may be one or more sensors or other mechanism configured to detect and/or communicate a rotation torque of the drill bit 30. One or more torque sensors may be physically associated with the drill bit 30 or may be a virtual sensor used to calculate a rotation torque based on sensed parameters such as rotation speed of the rotary head 26 and pressure at the rotary head 26. As such, rotation torque input 220 may include one or more sensors (e.g., a speed sensor) for detecting rotation speed of the rotary head 26 (and thus the drill bit 30) and a sensor (e.g., a pressure sensor) for detecting pressure of a fluid supply to the rotary head 26. The speed sensor may be disposed on or near the rotary head 26 and the pressure sensor may be disposed within a fluid supply line of the rotary head 26. Alternatively, any sensor associated with rotation torque input 220 may be disposed in other locations relative to the rotary head 26 and/or drill bit 30. Rotation torque input 220 may also derive rotation torque information from other sources, including other sensors.

Feed rate input 222 may be a sensor or other mechanism configured to detect and/or communicate a feed rate of the drill bit 30. Feed rate input 222 may communicate a feed rate signal indicative of a feed rate of the drill bit 30 to controller 210. For example, feed rate input 222 may monitor a rotation speed of a sheave of the cable and pulley system for moving rotary head 26 up and down along the mast frame 24. Feed rate input 222 may embody a conventional rotational speed detector (e.g., a rotary encoder) having a stationary element rigidly connected to a mounting bracket of the sheave that is configured to sense a relative rotational movement of the sheave (e.g., of a shaft of the sheave). The stationary element may be a magnetic or optical element mounted to the mounting bracket of the sheave and configured to detect rotation of an indexing element (e.g., a toothed tone wheel, an embedded magnet, a calibration stripe, teeth of a timing gear, etc.) connected to rotate with the shaft of the sheave. A sensor of feed rate input 222 may be located adjacent the indexing element and configured to generate a signal each time the indexing element (or a portion thereof) passes near the stationary element. The signal may be directed to controller 210, which may use the signal to determine a number of shaft rotations of the sheave, occurring within fixed time intervals, and use this information to determine the feed rate value. Feed rate input 222 may also derive feed rate information from other sources, including other sensors.

Rotation speed input 224 may be a sensor (e.g., a speed sensor) that may be configured to detect a rotation speed of the drill bit 30. Rotation speed input 224 may communicate a rotation speed signal indicative of a rotation speed of the drill bit 30 to controller 210. For example, rotation speed input 224 may monitor the rotation speed of the rotary head 26. Rotation speed input 224 may embody a conventional rotational speed detector having a stationary element rigidly connected to the rotary head 26 that is configured to sense a relative rotational movement of the rotary head 26 (e.g., of a rotational portion of the rotary head 26 that is operatively connected to the rotary head 26, such as a shaft of the rotary head 26 or the drill string 28 mounted on the rotary head 26). The stationary element may be a magnetic or optical element mounted to a housing of the rotary head assembly and configured to detect rotation of an indexing element (e.g., a toothed tone wheel, an embedded magnet, a calibration stripe, teeth of a timing gear, etc.) connected to rotate with the shaft of the rotary head 26. A sensor of rotation speed input 224 may be located adjacent the indexing element and configured to generate a signal each time the indexing element (or a portion thereof) passes near the stationary element. The signal may be directed to controller 210, which may use the signal to determine a number of shaft rotations of the rotary head 26, occurring within fixed time intervals, and use this information to determine the rotation speed value. Rotation speed input 224 may also derive rotation speed information from other sources, including other sensors.

For outputs of control system 200, feed command 230 may cause actuation of the hydraulic feed cylinder 34 and may cause a change of position of rotary head 26 up and down along the mast frame 24. As such, feed command 230 may control the feed rate of drill bit 30 into and out of the hole 50. Air supply command 232 may cause actuation of a valve in the air supply line of the rotary head 26. As such, air supply command 26 may control air pressure exerted on the drill bit 30. Drill string rotation command 234 may cause actuation of the valve of hydraulic fluid line of the rotary head 26. As such, drill string rotation command 234 may control the rotation speed of the drill string 28 (and thus the drill bit 30). Watering command 236 may cause actuation of a valve of the watering line. As such, the watering command 236 may control water pressure and amount of water of the watering line.

Figure 3:
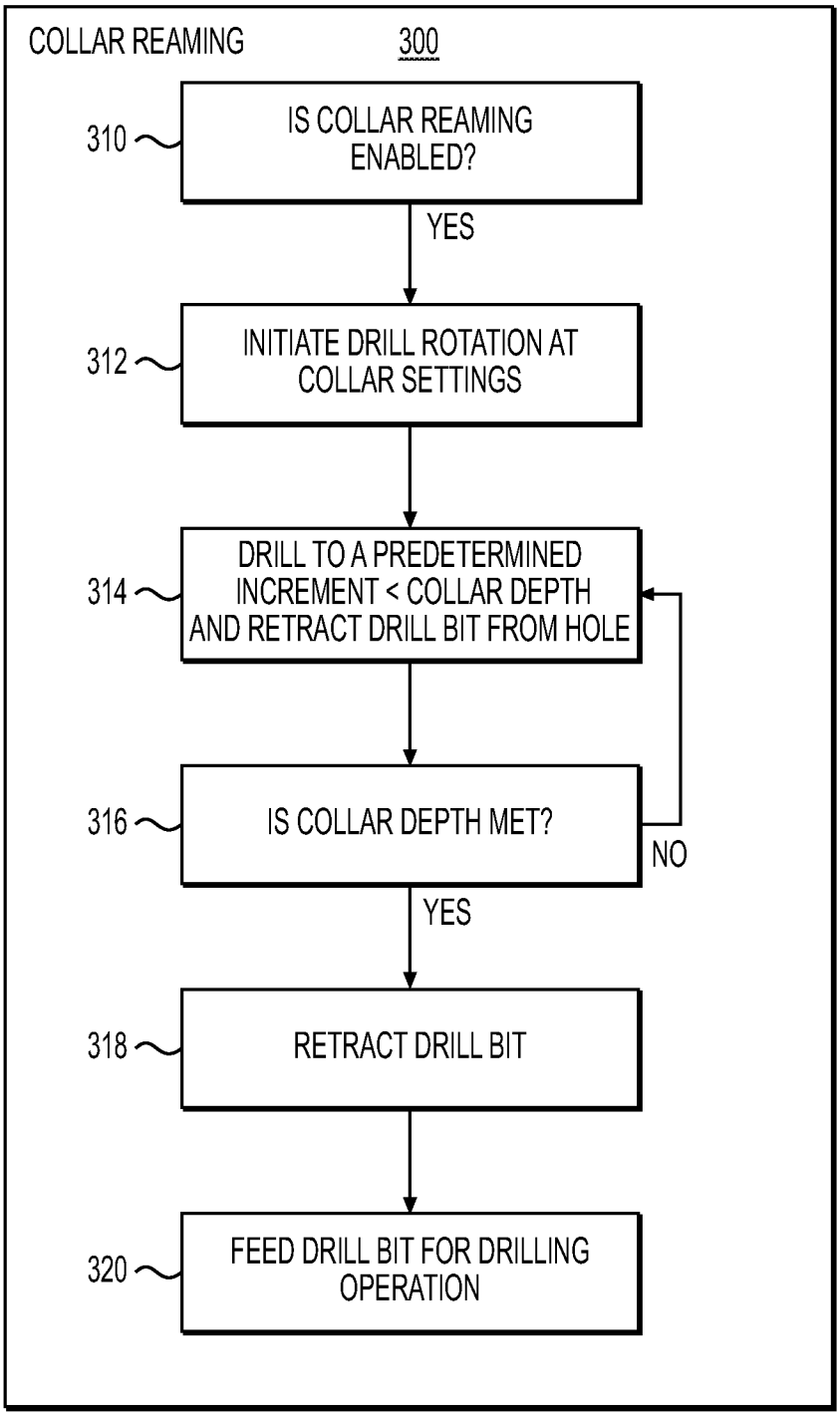
FIG. 3 is a flowchart depicting an exemplary collar reaming function of the collar control system if FIGS. 1 and 2.

FIG. 3 provides an exemplary collar reaming function 300 for the automatic collar operation. The collar reaming function 300 may be selectively enabled by an operator via input device 40. Alternatively, the collar reaming function may be set to always be enabled such that collar reaming occurs during every collar operation. Thus, collar reaming function 300 may include initiating collaring with reaming increments when collar reaming is enabled (step 310). When collar reaming is enabled, controller 210 may initiate drill rotation at collar settings (step 312). The collar settings may include a rotation speed and feed rate lower than a rotation speed and feed rate during the non-collar drilling operation (hereinafter "drilling operation"), and may include water and air supplied to the drill bit 30, but with more water and less air than the drilling operation. For example, controller 210 may provide a drill string rotation command 234 to initiate rotation of drill string 28 at the lower rotation speed than for the non-collar drilling of the hole.

When the drill rotation is at the collar settings, controller 210 may then provide a feed command 230 to feed the drill bit 30 (e.g., at the lower feed rate) to the ground to a predetermined increment and then automatically retract the drill bit 30 from the hole (step 314). The predetermined increment is less than the set collar depth. For example, the predetermined increment may be 200 mm and the set collar depth may be 1,600 mm. It is understood that these increments are exemplary only and that other increments to the collar may be implemented and the increments may be different. Further, the increments may include only one increment, two increments, or more than two increments. This process may be repeated to increase the collar depth by the predetermined increments until the desired collar depth is achieved (step 316—Yes). As will be detailed below with respect to FIG. 4, the collar depth may be a set value via operator input or a predetermined value stored in the memory of controller 210, or the collar depth may be a variable value determined in real time based on the sensed values of the collar operation. Further, if the last increment is less than a predetermined threshold (e.g., 50 mm), controller 210 may proceed directly to step 318 without retracting the drill bit 30 from the hole.

When the collar depth is achieved, controller 210 may retract the drill bit 30 from the bottom of the hole (step 318), but not necessarily out of the hole. The collar reaming function 300 (and the collar operation) may be discontinued when the collar depth is met and the drill bit 30 is retracted (step 318) prior to feeding the drill for drilling (step 320) for the drilling operation. For example, when the collar depth is met, controller 210 may retract drill bit 30 slightly from the bottom of the hole, and transition the drill for the drilling operation (e.g. increase the rotation speed, increase the feed rate, decrease watering, and increase air supply to the drill bit 30).

Figure 4:
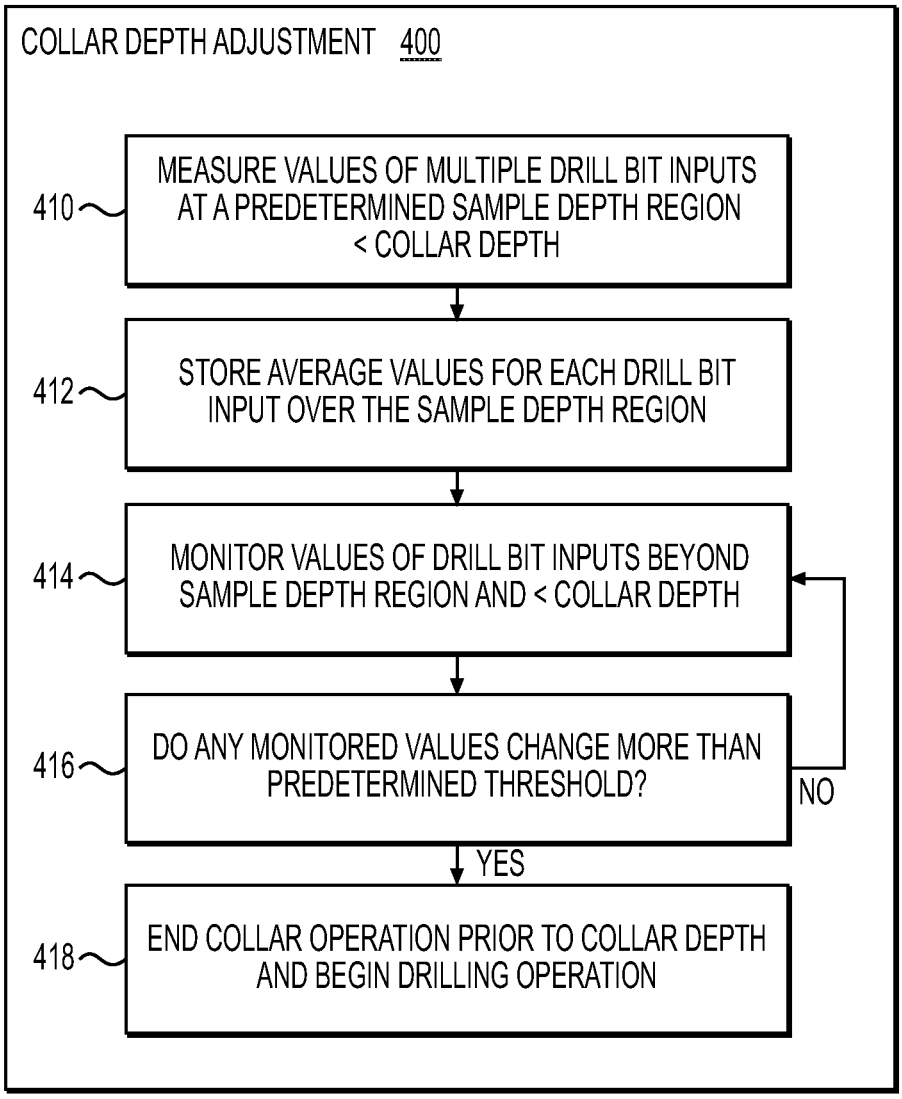
FIG. 4 is a flowchart depicting an exemplary automatic collar depth adjustment function of the collar control system of FIGS. 1 and 2.

FIG. 4 provides an exemplary automatic collar depth adjustment function 400 for the automatic collar operation. The automatic collar depth adjustment function 400 may be an automatic part of the collar function, or may be a function that is enabled and disabled by the operator or other entity associated with the drilling machine 10. During the collar operation, the automatic collar depth adjustment function 400 may include measuring values of multiple drill bit inputs at a predetermined sample depth region that is less than the set collar depth (step 410). For example, controller 210 may receive values of inputs 216-224 during the collar operation, e.g. bit air pressure, pulldown force, rotation torque, feed rate, and/or rotation speed. The predetermined sample depth region may be a small region (e.g., between two predetermined depths) of the collar portion 52 of hole 50. In one example the sample region may be located approximately at a midpoint of the collar depth, for example a region of 400-600 mm for a 1 meter collar depth. The predetermined sample depth region may be input by an operator or may be determined and stored by the manufacturer, an engineer, or other personnel associated with the operation of drilling machine 10.

Controller 210 may then store values for each drill bit input over the sample depth region (step 412). For example, controller 210 may average multiple measured values over the sample depth region for each input 216-224. When the drill bit 30 is moved beyond the sample depth region, and has not yet reached the set collar depth, controller 210 may monitor values of the drill bit inputs (step 414). For example, after the average values have been stored, controller 210 will continue to receive inputs 216-224 as the collar operation continues beyond the sample depth region.

The monitoring may continue until one or more of the monitored values changes by a predetermined threshold (step 416). The predetermined threshold may include a percentage or set value. For example, the predetermined threshold may correspond to a 20% change from the stored average value, or may be an absolute value change for the input 216-224 (e.g. a feed rate change of greater than 2 mm/s), or even merely be an absolute value alone for the input 216-224 in the post-sampling region that is indicative of an expected change from the average value. Further, the monitoring may continue until one or more of the monitored values changes by the predetermined threshold for a predetermined amount of time. For example, the predetermined amount of time may be one second. In some embodiments, each input 216-224 may include a predetermined weight factor that controller 210 stores when the monitored values for the corresponding input 216-224 changes by the predetermined threshold. The predetermined weight factor may be different for each input 216-224. The monitoring may continue until a sum of the stored predetermined weight factors exceeds a predetermined value. For example, the predetermined weight factor for each input 216-224 may be a fraction such that the monitoring continues until the stored predetermined weight factors sum to greater than or equal to 1.

When one or more of the monitored inputs 216-224 changes by the predetermined threshold, controller 210 may end the collar operation prior to reaching the set collar depth, and then may begin the drilling operation (step 418). For example, controller 210 may end the collar operation when any of the values of bit air pressure input 216, pulldown force input 218, or rotation torque input 220 changes (increases) by more than 20% for one second. Likewise, controller 210 may end the collar operation when any of the values of feed rate input 222 or rotation speed input 224 changes (decrease) by more than 20% for one second.

INDUSTRIAL APPLICABILITY

The disclosed aspects of collar control system 200 of the present disclosure may be used in any drilling machine having a collar mode.

As used herein, the terms automated and automatic are used to describe functions that are done without user intervention. Thus, the automatic collar operation, as well as the various functions of FIGS. 3-4, may all proceed without user intervention.

Such a collar control system 200 may help decrease the chances of a jam or clog during the collar operation and may also enable a faster overall drilling operation due to decreased collar time. For example, the disclosed system 200 may allow an operator to input desired hole settings and trigger (either manually or automatically) the collar operation. The disclosed system 200 may receive various sensor inputs, as described above, and control feed rate, drill string rotation, air supply, and watering supply functions to automatically collar a hole at reaming increments to the desired collar depth settings and/or to automatically adjust the collar depth settings. Such a system 200 may create a more intuitive operator control and may allow more autonomy of the drilling machine 10. Thus, the collar control system 200 of the present disclosure may help operators execute the collar operation and may help to reduce, or avoid, jams or clogs during the collar operation, while decreasing overall drilling time.

It will be apparent to those skilled in the art that various modifications and variations can be made to the disclosed system without departing from the scope of the disclosure. Other embodiments of the disclosure will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method for automated control of a collar operation of a mobile drilling machine using a drill bit mounted on a drill string, comprising:

automatically initiating rotation of the drill bit at a rotation speed based on collar settings, wherein the collar settings include at least a set collar depth;

automatically feeding the drill bit to form an initial hole at a predetermined reaming increment, the predetermined reaming increment being a distance that is a fraction of the set collar depth;

automatically retracting the drill bit from the initial hole when the predetermined reaming increment is reached; and repeating, until the set collar depth is reached, the steps of (i) automatically feeding the drill bit to increase a depth of the initial hole by the predetermined reaming increment and (ii) retracting the drill bit from the initial hole after the depth of the initial hole has increased by the predetermined reaming increment.

2. The method of claim 1, wherein the predetermined reaming increment includes a first increment to a first hole depth, and repeating the steps of automatically feeding the drill bit and automatically retracting the drill bit includes:

automatically feeding the drill bit at a second increment to a second hole depth, wherein the second hole depth is greater than the first hole depth, but less than a collar depth, and automatically retracting the drill bit from the second hole depth when the second hole depth is achieved.

3. The method of claim 1, further including:

ending the collar operation once the set collar depth is reached;

automatically retracting the drill bit from the bottom of the hole while still remaining partially inside the hole; and transitioning to a drilling operation.

4. The method of claim 3, wherein transitioning to a drilling operation includes:

automatically increasing the rotation speed of the drill bit for the drilling operation; and automatically feeding the drill bit at an increased feed rate for the drilling operation.

5. The method of claim 1, further including:

measuring values of multiple drill bit inputs at a predetermined sample depth region during the collar operation;

storing average values for each of the drill bit inputs over the predetermined sample depth region;

monitoring values of the drill bit inputs when the drill bit moves beyond the predetermined sample depth region; and ending the collar operation prior to the set collar depth when any of the monitored values change by a predetermined threshold.

6. The method of claim 5, wherein the predetermined sample depth region is less than the set collar depth.

7. The method of claim 5, further including:

ending the collar operation prior to the set collar depth when any of the monitored values change by the predetermined threshold for a predetermined amount of time.

8. The method of claim 5, wherein each of the drill bit inputs includes a predetermined weight factor, wherein the method further includes:

storing the predetermined weight factor for a respective drill bit input when the monitored value for the respective drill bit input changes by the predetermined threshold;

summing the stored predetermined weight factors; and ending the collar operation prior to the set collar depth when the summed predetermined weight factors exceeds a predetermined threshold.

9. The method of claim 1, further including:

monitoring values of multiple drill bit inputs over a predetermined sample depth region during the collar operation; and ending the collar operation prior to the set collar depth when any of the monitored values change by a predetermined threshold beyond the predetermined sample depth region.

10. The method of claim 1, wherein the predetermined reaming increment is less than or equal to one-eighth of the set collar depth.

11. A mobile drilling machine, comprising:

a mast including a mast frame;

a rotary head movably mounted on the mast frame, the rotary head controllable to rotate a drill bit mounted on a drill string at a rotation speed, wherein the rotary head is further controllable to move up and down the mast frame to feed the drill bit at a feed speed; and a controller configured to:

automatically initiate rotation of the drill bit at a rotation speed based on collar settings for a collar operation, wherein the collar settings include at least a set collar depth;

automatically feed the drill bit to form an initial hole at a predetermined reaming increment, the predetermined reaming increment being a distance that is a fraction of the set collar depth;

automatically retract the drill bit from the initial hole when the predetermined reaming increment is reached; and repeat, until the set collar depth is reached, the steps of (i) automatically feeding the drill bit to increase a depth of the initial hole by the predetermined reaming increment and (ii) retracting the drill bit from the initial hole after the depth of the initial hole has increased by the predetermined reaming increment.

12. The mobile drilling machine of claim 11, wherein the controller is further configured to:

measure values of multiple drill bit inputs at a predetermined sample depth region during the collar operation;

store average values for each of the drill bit inputs over the predetermined sample depth region;

monitor values of the drill bit inputs when the drill bit moves beyond the predetermined sample depth region; and end the collar operation prior to the set collar depth when any of the monitored values change by a predetermined threshold.

13. The mobile drilling machine of claim 12, wherein the predetermined threshold includes a percentage or set value.

14. The mobile drilling machine of claim 12, wherein the controller is further configured to:

end the collar operation prior to the set collar depth when any of the monitored values change by the predetermined threshold for a predetermined amount of time.

15. The mobile drilling machine of claim 12, wherein each of the drill bit inputs includes a predetermined weight factor, and wherein the controller is further configured to:

store the predetermined weight factor for a respective drill bit input when the monitored value for the respective drill bit input changes by the predetermined threshold;

sum the stored predetermined weight factors; and end the collar operation prior to the set collar depth when the summed predetermined weight factors exceeds a predetermined threshold.

16. The mobile drilling machine of claim 11, wherein the controller is further configured to:

automatically retract the drill bit from the initial hole when the predetermined reaming increment is achieved, but prior to reaching the set collar depth.

17. The mobile drilling machine of claim 16, wherein the predetermined reaming increment is a first increment to a first hole depth, and the controller is further configured to:

after automatically retracting the drill bit from the initial hole, automatically feed the drill bit at a second increment to a second hole depth, wherein the second hole depth is greater than the first hole depth, but less than the set collar depth; and automatically retract the drill bit from the second hole depth when the second hole depth is achieved.

18. The mobile drilling machine of claim 11, wherein the controller is further configured to:

automatically retract the drill bit when the set collar depth is achieved;

automatically increase the rotation speed of the drill bit for the drilling operation; and automatically feed the drill bit at an increased feed rate for the drilling operation.

19. The mobile drilling machine of claim 11, wherein the controller is further configured to:

monitor values of multiple drill bit inputs over a predetermined sample depth region during the collar operation; and end the collar operation prior to the set collar depth when any of the monitored values change by a predetermined threshold beyond the predetermined sample depth region;

automatically increasing the rotation speed of the drill bit for the drilling operation; and automatically feeding the drill bit at an increased feed rate for the drilling operation.

20. A method for automated control of a collar operation of a mobile drilling machine using a drill bit mounted on a drill string, comprising:

automatically initiating rotation of the drill bit at a rotation speed based on collar settings, wherein the collar settings include at least a set collar depth;

automatically feeding the drill bit at a feed rate to form an initial hole;

measuring values of multiple drill bit inputs at a predetermined sample depth region during the collar operation;

storing average values for each of the drill bit inputs over the predetermined sample depth region;

monitoring values of the drill bit inputs when the drill bit moves beyond the predetermined sample depth region; and ending the collar operation prior to the set collar depth when any of the monitored values change by a predetermined threshold.

* * * * *